US011982446B2

(12) United States Patent
Kimberlin

(10) Patent No.: US 11,982,446 B2
(45) Date of Patent: May 14, 2024

(54) OPTIMIZED OVERFIRE AIR NOZZLES, SYSTEM AND STRATEGY

(71) Applicant: Tyler K C Kimberlin, Fort Collins, CO (US)

(72) Inventor: Tyler K C Kimberlin, Fort Collins, CO (US)

( * ) Notice: Subject to any disclaimer, the term of this patent is extended or adjusted under 35 U.S.C. 154(b) by 14 days.

(21) Appl. No.: 17/405,876

(22) Filed: Aug. 18, 2021

(65) Prior Publication Data

US 2022/0252262 A1 Aug. 11, 2022

Related U.S. Application Data

(60) Provisional application No. 63/067,197, filed on Aug. 18, 2020.

(51) Int. Cl.
*F23L 1/00* (2006.01)
*F23J 3/02* (2006.01)

(52) U.S. Cl.
CPC . *F23L 1/00* (2013.01); *F23J 3/02* (2013.01); *F23L 2900/00* (2013.01)

(58) Field of Classification Search
CPC ..... F23L 1/00; F23L 3/02; F23L 2900/00
USPC ..... 110/182.5
See application file for complete search history.

(56) References Cited

U.S. PATENT DOCUMENTS 2,715,880 A * 8/1955 Hebert ..... F23G 5/12 110/254
3,742,916 A 7/1973 Wessberg
3,920,377 A * 11/1975 Yanuki ..... F23C 7/02 431/115
3,943,861 A 5/1976 Astrom
4,099,471 A 7/1978 Sander
4,425,855 A 1/1984 Chadshay
4,480,558 A 11/1984 Russell
4,494,004 A 1/1985 Mauer, IV et al.
4,545,308 A 10/1985 Zaterka
4,838,182 A 7/1989 Goodspeed
4,846,080 A 7/1989 Ross
5,564,632 A 10/1996 Prohazka
5,824,275 A 10/1998 Bitzer
6,148,743 A * 11/2000 Vatsky ..... F23L 9/00 110/297
6,164,956 A * 12/2000 Payne ..... F23J 3/00 122/390
6,192,810 B1 * 2/2001 Stallings ..... F23L 13/00 110/297
6,202,575 B1 * 3/2001 Bauver, II ..... F23C 5/32 110/297
6,431,125 B1 * 8/2002 Eriksson ..... F23L 9/00 432/2
7,665,458 B2 * 2/2010 Waltz ..... F23L 9/02 126/285 R
7,681,508 B2 3/2010 Taniguchi
7,878,130 B2 2/2011 Yamamoto
(Continued)

*Primary Examiner* — Justin M Jonaitis

(57) ABSTRACT

Nozzles for delivering air into a combustion system of a boiler including an interchangeable nozzle barrel. Nozzle barrels can be easily replaced for maintenance or to change the size and flow velocity of the nozzles to optimize combustion performance. Nozzles may include converging sections with an arc, double arc's, bell shaped, or hyperbolic curves around the entire perimeter of the nozzle and optimized for delivery of air into the combustion system from ducting or from within a plenum.

3 Claims, 2 Drawing Sheets

(56) References Cited

U.S. PATENT DOCUMENTS 8,646,394 B2 * 2/2014 Tamura ..... F23D 1/02
110/211
8,991,323 B2 * 3/2015 Larue ..... F23K 3/02
110/260

* cited by examiner

OPTIMIZED OVERFIRE AIR NOZZLES, SYSTEM AND STRATEGY

TECHNICAL FIELD

The present invention, called Optimized Overfire Nozzles along with Optimized Overfire Air System and Strategy, herein referred to as OOA, relates typically to combustion furnaces, boilers to the delivery of combustion air into combustion systems usually found in waste-to-energy facilities, pulp and paper mills, but also small wood and biomass furnaces, gasifiers, and large utility power plants. However, OOA can be used in a wide variety of applications beyond combustion systems, for example, anything used to mix two or more gases.

BACKGROUND INFORMATION

Air used for combustion that is delivered into a combustion system through multiple openings in the walls of a furnace is done so with very simple ports like that of U.S. Pat. No. 3,742,916 or more complex nozzles which accelerate the air flow through a nozzle, like that of U.S. Pat. No. 4,940,004 and/or nozzles that can effectively change the opening size to change the air flow quantity and/or velocity.

Examples include openings that utilize "velocity dampers" like those shown in U.S. Pat. Nos. 4,099,471 and 4,480,558 and 4,838,182 and 4,846,080 and 6,192,810 B1 or various moveable obstructions like those shown in U.S. Pat. Nos. 3,943,861 and 4,545,308 and 5,564,632 and 7,681,508 B2 where the exit itself changes in size and shape and "divided nozzles" with upstream dampers that can choke or block-off portions of a divided opening as shown in U.S. Pat. Nos. 4,425,855 and 5,824,275 and 7,665,458 and 7,878,130.

An opening fitted with, a velocity damper or moveable obstruction have a poor flow path which then require more pressure to overcome, and also it often negatively effects the resulting jet of air entering the furnace. These also have moving parts close to the opening, close to the high temperature and often corrosive, ash, and slag laden furnace section making them prone to plugging, seizing, failure, and/or high maintenance. Such complex designs can also be quite expensive.

An opening fitted with divisions and upstream dampers or the like can only be controlled and/or tuned to the degree with which it is divided, the more divisions, the more costly, complex and the larger the footprint. Often these have a better, but still a poor flow path. This also requires the nozzles and openings to be sized and divided very close to optimal to be effective.

SUMMARY DESCRIPTION

Many boilers are operated at a near constant load with little to no need for higher levels of combustion air control via changing overfire air opening size "on the fly". However these boilers still benefit greatly from optimized combustion air delivery. To truly optimize the combustion air delivery, the size of the openings need to be adjustable so the flow velocity can be changed independently of flow, and/or concurrently. OOA systems include at least one nozzle, but almost always multiple nozzles which can be optimized with interchangeable nozzle barrels of different sizes, further on the fly tuning and control is with upstream pressure and flow regulation. Flow rate can be calculated from the pressure measured at each individual nozzle, or for multiple nozzles. Pressure can be measured using typical pressure gauges, transducers, transmitters, etc. and is often used in the overall tuning and control strategy of the boiler. The OOA Strategy, Systems, and Nozzles optimize the location, arrangement, and especially nozzle size for one or a multitude of similar boilers operating at one or more facilities. The nozzles themselves also have no moving parts and a better flow path, often including smooth entrances, transitions, converging sections, connections, and nozzle barrels. The nozzle barrel is interchangeable, often along with the converging section or a portion of the converging section, the size, even the shape of the openings can be changed for tuning and/or changes in operation. Nozzles, being subjected to high temperature and often very corrosive environments of the furnace need to be periodically replaced, OOA Nozzles make this much easier and less expensive.

DESCRIPTION OF THE DRAWINGS

Some embodiments of the Optimized Overfire Air Nozzles are illustrated as examples and are not limited by the figures of the attached drawings, in which like references may indicate similar elements.

DETAILED DESCRIPTION OF THE OPTIMIZED OVERFIRE AIR NOZZLES

Various embodiments and aspects of OOA will be described with reference to details discussed within this application, and the accompanying drawings will illustrate the various embodiments. The following description and drawings are illustrative of OOA and are not to be construed as limiting. Specific details are described to provide a thorough understanding of the various embodiments. However, in certain instances, well-known or conventional details are not described in order to provide a concise discussion of the embodiments of OOA.

The terminology used herein is for the purpose of describing particular embodiments only and is not intended to be limiting of the invention. As used herein, the term "and/or" includes any and all combinations of one or more of the associated listed items. As used here I, the singular forms of "a," "an," and "the" are intended to include the plural forms as well as the singular forms, unless the context clearly indicates otherwise. It shall be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof.

Unless otherwise defined, all terms (including technical and scientific terms) used herein have the same meaning as commonly understood by one having ordinary skill in the art to which this invention belongs. It will be further understood that terms such as those defined in commonly used dictionaries, should be interpreted as having a meaning that is consistent with their meaning in the context of the relevant art and present disclosure and will not be interpreted in an idealized or overly formal sense unless expressly so defined herein.

In describing the invention, it will be understood that a number of techniques and steps are disclosed. Each of these has individual benefit and each can also be used in conjunction with one or more, or in some cases all, of the other disclosed techniques. Accordingly, for the sake of clarity, this description will refrain from repeating every possible combination of the individual steps in an unnecessary fashion. Nevertheless, the specification and claims should be read with the understanding that such combinations are entirely within the scope of the invention and claims.

Figure 1:
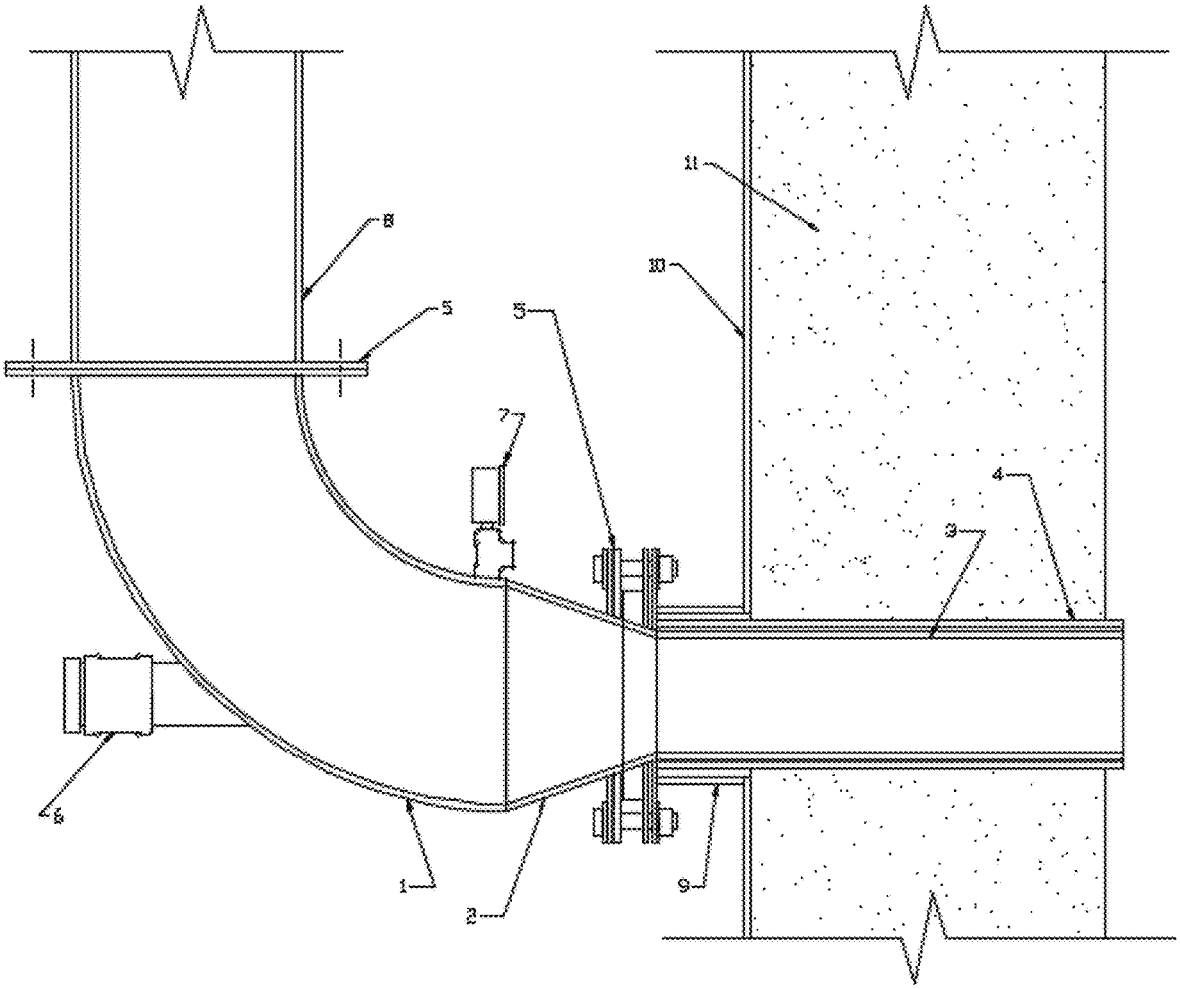
FIG. 1 depicts a cross-sectional view of one OOA Nozzle (usually of a multitude), utilizing a cone shaped converging section and an overhead duct, according to one embodiment.
Figure 2:
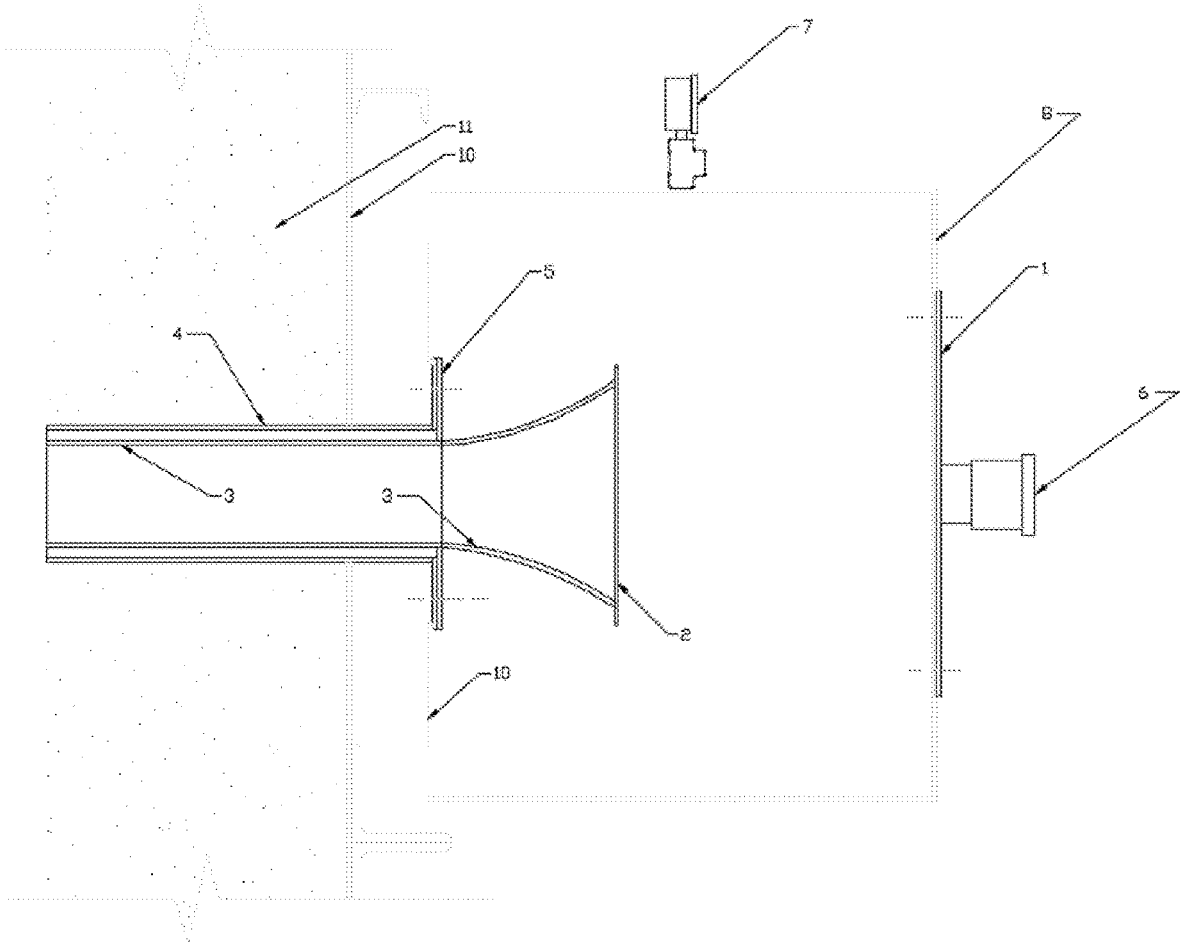
FIG. 2 depicts a cross-sectional view of one OOA Nozzle (usually of a multitude) utilizing a bell-shaped entrance and/or converging section within a plenum, according to one embodiment.

FIGS. 1 and 2 show embodiments of the Optimized Overfire Air Nozzle as being round in cross-section, round is ideal, but virtually any cross-section can be used. For example, an oval shape to better fit the tube-bend openings of a boiler wall. FIG. 2 shows the converging section as curved around the entire round perimeter (bell shaped), this is ideal, but a simpler straight converging section can be used as in FIG. 1.

FIG. 1 shows one embodiment of an Optimized Overfire Air Nozzle being fed combustion air by a duct 7. From the duct the air is transitioned from vertical to horizontal, to a converging section 2 where the flow is accelerated, then to a nozzle barrel 3. The flow path of the transition and converging section are as smooth as practical, and the nozzle barrel sufficiently long so as to pass through the furnace skin, casing, refractory and/or boiler tube openings 10,11 and to produce a good jet of air entering the furnace. There is an access port 6 adjacent to the nozzle barrel so that build-up can be removed, usually with a long rod, the port is often fitted with high temperature glass so that buildup, corrosion, and furnace conditions can be easily monitored. The embodiment in FIG. 1 shows one possible method for changing or replacing nozzles where the elbow and most of the converging section is a spool piece 1,2 that is first disconnected from the upstream duct and the downstream nozzle to give adequate space for the nozzle to be removed.

FIG. 2 shows one embodiment of an Optimized Overfire Air Nozzle being fed combustion air by a plenum 8 which feds air to multiple nozzles. The plenum could be an air/wind box, basically anything with a large open area or duct usually meant for distributing air to multiple ports or multiple areas on a furnace/boiler by which the nozzle is connected to or fits within. The embodiment in FIG. 2 show another possible method for changing or replacing nozzles where the access panel 1 is removed to allow for adequate space for the nozzle to be removed. Attached to the access panel is the sight/rod-out port 6 for monitoring and removing build-up. Nozzles could alternatively be easily fitted with automatic buildup removal, port-rodders.

The combustion air doesn't have to be air, it can be any gas used for combustion, or a mixture of gas and air, entrained combustible particulate, etc.

There is a sleeve which the interchangeable nozzle barrel fits within and is often the largest nozzle for a given application. Small changes to the flow area of the nozzle barrel can result in large changes in combustion, often the interchangeable barrels are simply different thicknesses, smaller ID for a small change in the flow area. Varying barrel thickness can also be used for corrosion control. The connections 5 shown are simple bolted flanges, but there are many possibilities for different connection types. Likewise, the mount 9 is a simple stub welded to the furnace casing 10, but the nozzle/assembly could be mounted many different ways.

Mounted upstream of the nozzle barrel is a connection 7 for a test port, pressure gauge and/or pressure transmitter that can be used for tuning, control and/or determining the rate of flow through the nozzle(s).

The interchangeable/replaceable nozzle barrel can include all of the converging section, a portion of the converging section, none of the converging section and/or separate interchangeable converging sections. The nozzle barrel could also have a simple taper at the entrance to transition to the converging section for small changes in barrel size. A perfect transition may be sacrificed for simpler interchangeability.

Often facilities have "sister combustion systems" that are similar if not identically sized and shaped furnaces usually with sister boilers and utilizing the same fuel. Once the nozzle barrel size along with location is determined using the interchangeable barrels on one combustion system, subsequent installations on sister combustion systems can utilize similar free flowing nozzles but without interchangeable barrels. The location and size of which is determined from the findings of the first installation that used the nozzles with interchangeable barrels.

The invention claimed is:

1. An interchangeable Overfire air nozzle system for delivering air into a combustion system comprising:

a spool piece comprising at a first end a connection for connecting to an air duct of the combustion system for feeding air to said nozzle;

said spool piece functioning as a removable section with a smooth flow path without obstruction and including a sight for monitoring and removing build-up and a test port connection allowing for a pressure gauge and/or a pressure transmitter for tuning and providing data related to controlling the rate for flow through the nozzle;

a converging section connected to a second end of said spool piece, an interchangeable nozzle barrel connected at a first end to said converging section via a second connection;

said second connection which allows for a repeatable removal and reinstallation of said nozzle barrel;

said nozzle barrel at a second end including an outlet;

wherein said system allows said interchangeable nozzle barrel to be removed and replaced with an interchangeable nozzle barrel of differing dimensions such that a user can change and utilize the nozzle barrel, observe results, and replace the nozzle barrel until a desired result is maximized.

2. The interchangeable overfire air nozzle system of claim 1 further comprising:

Said converging section having a hyperbolically curved profile.

3. A method of optimizing a combustion system comprising:

a) Providing a spool piece comprising at a first end a connection for connecting to an air duct of the combustion system;

a converging section connected to a second end of said spool piece;

b) Providing at least one interchangeable nozzle barrel connected to the converging section by a connection which allows for repeatable removal and reinstallation of said nozzle barrel;

c) Running the combustion system and observing a result of combustion air delivery;

d) If the results are not optimized removing the at least one interchangeable nozzle barrel and providing at least one interchangeable nozzle barrel having different characteristics and repeating steps c and d until the system is optimized, wherein said characteristics are size or shape.

* * * * *